US010428596B2

(12) United States Patent
Simpson

(10) Patent No.: US 10,428,596 B2
(45) Date of Patent: Oct. 1, 2019

(54) DOWNHOLE TOOL AND METHOD

(71) Applicant: Neil Andrew Abercrombie Simpson, Aberdeen (GB)

(72) Inventor: Neil Andrew Abercrombie Simpson, Aberdeen (GB)

(73) Assignee: PARADIGM DRILLING SERVICES LIMITED, Scotland (GB)

( * ) Notice: Subject to any disclaimer, the term of this patent is extended or adjusted under 35 U.S.C. 154(b) by 212 days.

(21) Appl. No.: 14/379,174

(22) PCT Filed: Feb. 18, 2013

(86) PCT No.: PCT/GB2013/050390

§ 371 (c)(1),
(2) Date: Aug. 15, 2014

(87) PCT Pub. No.: WO2013/121231

PCT Pub. Date: Aug. 22, 2013

(65) Prior Publication Data

US 2015/0013997 A1 Jan. 15, 2015

(51) Int. Cl.
*E21B 17/10* (2006.01)
*E21B 23/00* (2006.01)

(52) U.S. Cl.
CPC .... *E21B 17/1064* (2013.01); *E21B 2023/008* (2013.01)

(58) Field of Classification Search
CPC ..... F16L 57/00; E21B 17/1078; E21B 17/10; E21B 17/1042; E21B 19/24; E21B 17/1064
See application file for complete search history.

(56) References Cited

U.S. PATENT DOCUMENTS 2,715,552 A * 8/1955 Lane ..... E21B 17/1042 175/325.5
3,449,022 A * 6/1969 Minor ..... E21B 17/105 175/325.6
4,948,178 A * 8/1990 Sauer ..... F16L 33/02 285/242

(Continued)

FOREIGN PATENT DOCUMENTS

RU 2225497 C2 3/2004
SU 627230 A1 10/1978

(Continued)

OTHER PUBLICATIONS

International Search Report, dated Mar. 26, 2014, 4 pages.
Original and English translation of Decision on Grant dated Dec. 5, 2017.

*Primary Examiner* — Kipp C Wallace
(74) *Attorney, Agent, or Firm* — William H. Honaker; Dickinson Wright PLLC

(57) ABSTRACT

A method of manufacture and installation of a resizable, plastically deformable or crimpable elastomeric bearing collar or stabilizer sleeve which can be installed over upset sections of rotary drilling and wellbore completion tubulars such as but not limited to subs, drill collars, drill pipe, wellbore casing, production liners and other drilling and production related tubulars that are run down-hole. In order to enable the reduction of rotational torque generated when directionally drilling and completing extended reach development (ERD) wells.

25 Claims, 8 Drawing Sheets

(56) References Cited

U.S. PATENT DOCUMENTS

| | | | | |
|---|---|---|---|---|
| 5,069,297 | A | 12/1991 | Krueger | |
| 5,148,876 | A | 9/1992 | Wilson | |
| 5,743,333 | A * | 4/1998 | Willauer | 166/122 |
| 5,803,193 | A | 9/1998 | Krueger | |
| 6,152,220 | A * | 11/2000 | Carmichael | E21B 37/02 166/173 |
| 7,857,063 | B2 * | 12/2010 | Thornton | E21B 17/1078 166/207 |
| 2003/0062170 | A1 * | 4/2003 | Slack | E21B 43/086 166/377 |
| 2005/0150654 | A1 * | 7/2005 | Kirk | E21B 43/103 166/206 |
| 2009/0266618 | A1 * | 10/2009 | Mitchell | E21B 17/105 175/325.7 |
| 2010/0326671 | A1 * | 12/2010 | Buytaert | B25B 27/10 166/378 |
| 2010/0326738 | A1 | 12/2010 | Boulet | |
| 2012/0125601 | A1 * | 5/2012 | Mussig | B01D 29/46 166/235 |
| 2015/0308595 | A1 * | 10/2015 | Lee | F16L 21/08 285/349 |

FOREIGN PATENT DOCUMENTS

| | | | |
|---|---|---|---|
| WO | 2009132301 | A1 | 10/2009 |
| WO | 2010136806 | A2 | 12/2010 |

* cited by examiner

DOWNHOLE TOOL AND METHOD

CROSS-REFERENCE TO RELATED APPLICATION

This U.S. National Stage Patent Application claims the benefit of International Application serial number PCT/GB2013/050390 filed Feb. 18, 2013, which claims the benefit of GB 1202640.7 filed on Feb. 16, 2012, the entire disclosures of the applications being considered part of the disclosure of this application, and hereby incorporated by reference.

FIELD OF THE INVENTION

This invention relates to a downhole tool, method and assembly and more particularly, but not exclusively, to a downhole tool, assembly and method for reducing torque and/or drag in rotary assembles used in the drilling or completion of high angle or horizontal wellbores in the oil and gas industry.

BACKGROUND TO THE INVENTION

Within the oil and gas industry, the continuing search for and exploitation of oil and gas reservoirs has resulted in the development of directionally drilled exploration and production well boreholes, that is boreholes which extend away from vertical and which permit the borehole to extend into the reservoir to a greater extent than with conventional vertical well boreholes.

Directionally drilled boreholes are now being drilled deeper, longer and higher in angle (from vertical) than previously, with boreholes now being drilled horizontally for considerable distances through the reservoir. Indeed, in some cases the horizontal step out from the surface location of the drilling site may be in excess of 10 kilometers.

It will be recognised that in vertical or near vertical wellbores, most if not all of the tubulars, e.g. drilling tubulars, or string will normally be hanging in tension and apply little in the way of side forces on the wellbore. By contrast, in some high angle or horizontal wellbores, the majority of the lower portion of the tubulars or string will instead be lying on the low side of the borehole with their weight acting on the borehole wall, and generating considerable torsional friction when the tubulars are rotated from surface.

As the horizontal section of the borehole is extended, this torsional friction component increases the applied torque required from surface to rotate the tubulars, to the point where the tubulars are no longer able to transmit sufficient torque to rotate the lower portion of the assembly and to provide power to the drilling process.

A number of methods of reducing rotational torsional losses in the horizontal section of a borehole have been developed. In some instances, friction reducers have been used in the drilling fluids. Alternatively, or additionally, friction reducing non-rotating collars or stabiliser sleeves may be installed on the tubulars used in the horizontal section. In some instances, friction reducing collars or non-rotating stabiliser sleeves may be installed as part of a sub-based tool installed between the drill pipe connections. In other instances, friction reducing collars or non-rotating stabiliser sleeves may be attached to the tubular body of the drill pipe by means of a re-joinable split joint or by means of a clamp.

Each of the above proposed methods for reducing friction and/or drag nevertheless suffer from drawbacks. For example, the provision of a separate sub-based tool provided between tubular joints results in a spacing of 30 feet (9.2 meters) between tools. The requirement for a separate sub also means that the length of tubular handled at the rig floor and in the stacking area is increased, thereby increasing handling time, failure potential and maintenance costs. The requirement for a separate sub also increase the number of connections in a given length or string of drilling tubulars, again increasing handling time, failure potential and maintenance costs.

In the case of split sleeves or clamped on devices, their complexity adds to the risk of failure, to the handling time for installation and/or removal. In some instances, it has been known that such tools can become detached and lost in the hole, requiring workover operations at significant expense to the operator.

In order to gain any substantial benefit from torsional friction reducing devices such as those described above in long horizontal sections of borehole, it is necessary to run considerable numbers of these devices to ensure that the majority of the drilling tubulars in the horizontal section of borehole are supported off the low side of the borehole and rotate in robust efficient bearings. This results in numerous points of contact between the drilling tubulars and the low side of the borehole, each of which increase friction and requiring additional torque from surface.

SUMMARY OF THE INVENTION

Aspects of the present invention relate to tools, assemblies and methods for reducing torque and/or drag in downhole environments.

According to a first aspect of the present invention, there is provided a downhole tool comprising a collar for location on a tubular body, the collar reconfigurable from a first diameter configuration to a second, smaller, diameter configuration.

According to a second aspect of the present invention, there is provided a method comprising:

providing a downhole tool comprising a collar;

locating the collar on a tubular body;

reconfiguring the collar from a first diameter configuration to a second, smaller, diameter configuration.

In use, the collar may be configured for location over the tubular body in the first configuration. The collar may be configured for translation along the tubular body in the first diameter configuration. The collar may be reconfigured to define the smaller second diameter configuration. The collar may be configured to engage, to be secured to, and/or retained on the tubular body in the second diameter configuration.

Reconfiguring the collar from the first diameter configuration to the second diameter configuration may comprise plastically deforming the collar or part of the collar. Reconfiguring the collar from the first diameter configuration to the second diameter configuration may comprise swaging the collar or part of the collar. Reconfiguring the collar from the first diameter configuration to the second diameter configuration may comprise crimping the collar or part of the collar. Reconfiguring the collar from the first diameter configuration to the second diameter configuration may comprise crushing the collar or part of the collar.

Beneficially, embodiments of the present invention may be attached or otherwise located on a tubular body, such as a drilling tubing section, a completion tubing section, tubular string or the like, without the need for split, clamped or threaded attachment means. For example, the collar may be configured/provided with an initial internal diameter which permits the collar to pass over the tubular body and then reconfigured from the first diameter configuration to the second configuration of smaller internal diameter, by plastic deformation, swaging, crimping or crushing the collar onto the tubular body. Since the downhole tool may be configured for location over the tubular body in the first configuration, and in particular but not exclusively, over any upsets or larger diameter portions provided on the tubular body which would normally prevent installation of a collar on sections of tubing of smaller diameter than that of the upset, one or more downhole tool may be provided at any required location or locations and at any required spacings along the length of the tubular body. Since the downhole tool need not be provided on a separate sub-based tool, the length of tubular handled at the rig floor and in the stacking area and/or the number of connections that must be made up may be reduced, thereby reducing handling time, failure potential and maintenance costs.

Embodiments of the present invention may be used in many downhole applications.

The collar may comprise a sleeve. For example, the collar may comprise or form part of a stabiliser sleeve.

In particular embodiments, the downhole tool may comprise or form part of a friction reducing collar.

In use, the downhole tool, for example the collar, may be configured to engage a borehole wall (for example in an open hole application) or other tubular, such as casing or liner (for example in a cased hole application). The downhole tool, for example the collar, may be configured to support and/or offset the tubular body from a wall of the borehole or tubular.

The collar may be rotatably mounted on the tubular body. The collar may be rotatably mounted on the tubular body in the second configuration. The collar may be configured to engage, to be secured to, and/or retained on the tubular body in the second diameter configuration with a running fit. In use, the collar may be rotatably mounted on the tubular body so that the tubular body may rotate within the collar.

Beneficially, embodiments of the present invention may support the tubular body, for example a rotating drill string, completion string or the like, within a borehole or tubular body and reduce or mitigate frictional losses that may otherwise occur between the rotating tubular body and the borehole or tubular wall. Indeed, it has been found that embodiments of the present invention may reduce the coefficient of friction between the tubular body and the borehole wall in a high angle or horizontal borehole from about 0.25 or 0.3 to about 0.1.

At least one of the tubular body and the collar may comprise or define part of a bearing.

The collar may comprise or form part of a bearing. The bearing may comprise a fluid lubricated bearing, for example but not exclusively a drilling fluid (mud) lubricated bearing.

The collar may be configured to engage, to be secured to, and/or retained on a smaller diameter section of the tubular body in the second diameter configuration. The smaller diameter section of the tubular body may, for example, comprise a bearing journal, recess, preformed location, or the like.

The collar may be of any suitable form and construction.

The collar may be configured to permit a reduction in inner diameter from the first configuration to the second configuration of up to 10%.

The collar may be configured to permit a reduction in inner diameter from the first configuration to the second configuration of up to 20%. The collar may be configured to permit a reduction in inner diameter from the first configuration to the second configuration of up to 30% or greater.

The collar may comprise a deformable portion. The deformable portion may permit reconfiguration of the collar from the first diameter configuration to the second diameter configuration. The deformable portion may comprise a ductile material. The deformable portion may comprise a ductile metal.

In particular embodiments, the collar may comprise a plurality of components coupled or formed together. The collar may comprise a composite component.

The collar may comprise a core. The core may comprise a cylindrical tubular body, ring or the like. In use, reconfiguring the collar from the first diameter configuration to the second diameter configuration may comprise reconfiguring the core. Where the collar is configured for location on a recess, or journal on the tubular body, the core may sit below the upset parts of the recess or journal. Beneficially, configuring the core to sit below the upset parts of the recess or journal maintains the structural integrity of the collar in the event of wear of the collar. The core may comprise or form part of the deformable portion of the collar.

The collar may comprise at least one outer layer.

The outer layer may be provided on at least one surface of the core. The outer layer may be provided on an inner surface of the core. The outer layer may be provided on an outer surface of the core. The outer layer may be provided on at least one side surface of the core. The outer layer may be interposed between the core and the tubular body. The outer layer may encapsulate the core.

The collar, or part of the collar, may be constructed from a metallic material, metallic alloy or the like. The collar, or part of the collar, may be constructed from grade 316 stainless steel. Alternatively, the collar or part of the collar, for example the core, may be constructed from a shape memory material, for example a shape memory metal.

The collar, or part of the collar, may be constructed from a polymeric material. The collar, or part of the collar, may be constructed from an elastomeric material. The elastomeric material may comprise a filled elastomer. In particular embodiments, the elastomeric material may comprise HNBR or the like.

In particular embodiments, the collar may comprise a metallic material core encapsulated in an elastomeric material outer layer.

The collar may comprise at least one perforation. The collar may comprise a plurality of perforations. One or more perforation may be circular. The collar may be configured so that reconfiguring the collar from the first diameter configuration to the second diameter configuration collapses one or more perforation. The provision of perforations facilitates controlled reconfiguration of the collar from the first diameter configuration to the second diameter configuration. In particular embodiments, the at least one perforation may be provided in the core.

The collar may be configured so that reconfiguring the collar from the first diameter configuration to the second diameter configuration extrudes or deforms the outer layer, for example the elastomeric material. In particular embodiments, the collar may be configured so that reconfiguring the collar from the first diameter configuration to the second diameter configuration extrudes or deforms part of the outer layer through one or more perforation. The extruded or deformed outer layer may form raised sections or buttons, e.g. of elastomeric material, disposed between the collar and the tubular body. Beneficially, these raised sections or buttons may create multiple bearing points on the tubular body, creating a fluid lubricated bearing surface between the internal bore of the collar and the tubular body. These raised sections or buttons of elastomeric material may alternatively or additionally provide clearance space around them for fluid cooling and cleaning.

In alternative embodiments of the present invention, the collar may be non-rotatably mounted on the tubular body. For example, the collar may be configured to engage, to be secured to, and/or retained on the tubular body with an interference fit or the like. In use, the collar may be configured to grip the tubular body in the second configuration. Where a recess is provided in the tubular body, the collar may be configured to grip the recess. Alternatively, or additionally, the collar may be configured to grip on externally flush tubular, such as casing, liner or drill pipe.

In alternative embodiments, the collar may comprise or form part of a traction member. For example, embodiments of the present invention may beneficially provide downhole traction or thrust to urge the tubular body and any connected components along the borehole or bore-lining tubular and may eliminate or reduce the need to transmit longitudinal force from surface, for example in high angle or horizontal boreholes where it may not otherwise be possible to accurately control movement from surface. Embodiments of the present invention may provide controlled movement without the risk of the string becoming stuck due to the capstan effect. Embodiments of the invention may reduce the requirement for compressive forces to be transmitted from surface, thereby eliminating or reducing the detrimental effects of "stick slip" and permitting effective controllable weight on bit.

The collar or traction member may be mountable on the tubular body so as to define a skew angle relative to a longitudinal axis of the tubular body and may be configured to engage a wall of a borehole or bore-lining tubular to urge the tool along the wall of the borehole or bore-lining tubular on rotation of the tubular body relative to the collar. The provision of a skew angle introduces a longitudinal force component to the interaction between the collar and the wall of the borehole or bore-lining tubular which acts to urge the tubular body along the borehole or bore-lining tubular. Accordingly, the collar or traction member may roll in a helical path rather than a circumferential path around the inside of the borehole or bore-lining tubular wall. This rolling helical path may have the effect of transporting the tool and any connected tubulars or components, such as a drill string, running string or completion string, along the wall of the borehole or bore-lining tubular.

The collar or traction member may be mountable on the tubular body so that the collar or traction member is offset from a central longitudinal axis of the tubular body. The tool may thus be configured so that the tool defines at least one point or area of contact with the wall of the borehole or bore-lining tubular. In some embodiments, the tool may be configured to define a plurality of points or areas of contact with the wall of the borehole or bore-lining tubular. In particular embodiments, the tool may be configured so that the tool defines three or more points or areas of contact with the wall of the borehole or bore-lining tubular. Embodiments of the invention may provide at least one of wear protection, torque reduction and/or centralisation by offsetting the tubular body and any connected components from contacting the low side of the borehole or bore-lining tubular.

The collar or traction member may be rotatably mountable on the tubular body so that the tubular body rotates within the collar or traction member. In use, the tubular body may rotate within the inner circumferential surface of the collar or traction member.

In particular embodiments, the collar or traction member may be configured to be directly mounted on the tubular body. In other embodiments, the collar or traction member may be configured to be indirectly mounted on the tubular body.

The collar or traction member may be rotatably mountable on the tubular body so that the collar or traction member transmits force to the tubular body. For example, the collar or traction member may be rotatably mountable on the tubular body so that the collar or traction member transmits the longitudinal force component to the tubular body to urge the tool and any coupled components along the borehole or bore-lining tubular wall.

The tool may comprise a single collar or traction member.

In particular embodiments, the tool may comprise a plurality of collars or traction members. The number and arrangement of the collars or traction members may be configured to provide the points or areas of contact with the wall of the borehole or bore-lining tubular. For example, the collars or traction members may be configured to provide angularly spaced points or areas of contact with the wall of the borehole or bore-lining tubular.

Where the tool comprises a plurality of collars, one or more of the collars may be configured to be rotatably mounted on the tubular body, and may for example comprise a friction reducing collar.

Where the tool comprises a plurality of collars, one or more of the collars may be configured to be non-rotatably mounted on the tubular body.

Where the tool comprises a plurality of collars, one or more of the collars may comprise or form part of a traction member.

The collars or traction members may be configured for location along the length of a section of the tubular body.

In particular embodiments, a plurality of the collars or traction members may be configurable for location on the tubular body, wherein the collars or traction members are longitudinally spaced along the length of the tubular body. Beneficially, axially spacing the collars or traction members may distribute the load exerted by the tool on the surrounding borehole or bore-lining tubular, and may reduce or prevent damage to the borehole or bore-lining tubular which may otherwise occur were the tool to exert point loads on the borehole or bore-lining tubular. This may be particularly beneficial where the tool is located with a weak or unconsolidated section of borehole which may be susceptible to collapse.

In some embodiments, a plurality of the collars or traction members may be configurable for location on the tubular body in abutting relation to each other. One or more collar or traction member may be configured to engage with at least one other collar or traction member. For example, the collar or traction member or members may comprise a collar or traction member coupling arrangement for coupling the collar or traction member to at least one other collar or traction member. The collar or traction member coupling arrangement may comprise at least one of a mechanical coupling arrangement, an adhesive bond, a quick connect device, male and female connector or the like.

The collar or traction member may comprise a radially extending rib or blade or other upset diameter portion. In use, the rib or blade may engage the wall of the borehole or bore-lining tubular. The rib or blade may be of any suitable form. In particular embodiments, the rib or blade may define a spiral configuration, either on a single traction member or in combination with at least one other traction member. Beneficially, a spiral configuration may assist in uplift or movement of drill cuttings lying on the low side of the borehole, for example.

The collar or traction member may comprise a single rib or blade. Alternatively, the collar or traction member may comprise a plurality of ribs or blades. In particular embodiments, the collar or traction member may comprise three ribs or blades, four ribs or blades or five ribs or blades. Where the collar or traction member comprises a plurality of ribs or blades, these may be located at circumferentially spaced positioned around the collar or traction member. The number and arrangement of the collar or traction members and the number and arrangement of the ribs may be configured to provide the desired points or areas of contact with the wall of the borehole or bore-lining tubular. By way of example, in particular embodiments the tool may comprise six collars or traction members, each collar or traction member having three blades provided at 120 degrees around the circumference of the traction member.

Longitudinal cut out portions may be provided in the upset diameter portion of the tubular body to provide fluid and/or debris bypass when the tool is in operation.

The rib or blade may be integrally formed with the collar. Alternatively, the rib or blade may comprise a separate component formed or coupled to the collar.

At least part of the collar or traction member may comprise, be formed with or receive a hard faced material or may be subject to a surface hardening treatment. Any suitable hard faced or treatment may be utilised. For example, the hard faced material or treatment may comprise one or more of hard banding, carbide inserts, polycrystalline diamond compact, or the like In particular embodiments, the hard faced material or treatment may comprise a diamond matrix for example but not exclusively a laser applied diamond matrix. The provision of a hard faced material or hardening collar or traction member may be particularly beneficial where the tool is used in an open hole environment, that is the tool is configured to engage the wall of an uncased or lined borehole, as this may protect the collar or traction member from damage caused by the borehole environment, including for example but not exclusively drill cuttings in the bore, borehole formations, and/or fluid passage through the annulus between the tool and the borehole. Alternatively, or additionally, the provision of hard-facing material or surface hardening treated areas may also enhance grip. In some embodiments, the provision of hard-facing material or surface hardening treated may facilitate a reaming action.

At least part of the collar or traction member may comprise, be formed with or receive an elastomeric or other resilient material. Any suitable elastomeric or resilient material may be utilised. In particular embodiments, the material may comprise hydrogenated nitrile butadiene rubber or polyurethane material, although any suitable material may be utilised. The provision of an elastomeric or resilient material may be particular beneficial where the tool is used in a bore-lining tubular, such as casing, as this may protect or other prevent or mitigate damage to the bore-lining tubular.

As described above, the collar or traction member may mountable on the tubular body so as to define a skew angle relative to a longitudinal axis of the tubular body and is configured to engage a wall of a borehole or bore-lining tubular to urge the tool along the wall of the borehole or bore-lining tubular on rotation of the traction member relative to the tubular body. The skew angle may be provided by any suitable means.

For example, the collar or traction member may be formed to define the skew angle and offset. Alternatively, or additionally, the collar may be formed to define the skew angle. Alternatively, or additionally, the tubular body may define the skew angle. In particular embodiments, the tubular body defines the skew angle and the tubular body may be formed or otherwise constructed to form a plurality of skewed journals for receiving a plurality of collars or traction members. It is envisaged that the tubular body may be formed in a similar way to a multi-cylinder internal combustion engine crank shaft, with very slight offset on the cranks and these cranks being very slightly angled or skewed. Beneficially, the provision of a single unit provides structurally reliable attachment means for the collar or traction member or members whilst maintaining the structural integrity of the tubular body.

The angle of skew of the collar or traction member may be selected to urge the tool along the wall of the borehole at a selected rate. The skew angle could be relatively small, for example 1 degree or less than one degree. As the rotational speed of rotary drilling assemblies is normally limited between 100 and 200 rpm and the borehole diameter of the section drilled through the reservoir is generally but not always 8.5" (about 216 mm) or less, and the drilling rate of penetration generally below 100 ft. per minute (about 0.51 meters per second), then the skew angle required to provide efficient forward traction and transport system is relatively small, for example 1 degree or less. In particular embodiments, the skew angle may be 0.5 degrees. By way of example, half a degree skew angle may provide a forward thrust speed of 170 ft. per hour at 150 rpm approximately. In other embodiments, the skew angle may be between 1 degree and 5 degrees. In other embodiments, the skew angle exceeds 5 degrees. However, in some circumstances it may be desirable for the skew angle to be higher.

The direction of skew angle of the collar or traction member may be selected to urge the tool in the selected direction along the wall of the borehole. For example, the direction of skew angle may be selected to urge the tool in the forward or downhole direction. In particular embodiments, is it envisaged that the tool will be configured so that right hand rotation of the tubular body will result in the tool being urged in the forward or downhole direction. However, the direction of skew angle may alternatively be selected to urge the tool in the reverse or uphole direction. In order to provide efficient reverse traction, it is envisaged that a reverse skew angle may be in the range of about 3 degrees to about 5 degrees.

As described above, the collar or traction member may be mountable on the tubular body so that the collar or traction member is offset from a central longitudinal axis of the tubular body. The offset may be provided by any suitable means. In particular embodiments, the offset may be provided by the tubular body. Accordingly, the tubular body may be formed or otherwise constructed to form a plurality of offset and skewed journals for receiving a plurality of traction members.

In particular embodiments, the downhole tool may be configured to selectively provide traction with the borehole wall. For example, the tool may be configured so that engagement between a first portion of the tool and the borehole wall, for example a high side of the borehole or tubular wall, induces traction between the tool and the borehole and engagement between a second portion of the tool and the borehole or tubular wall, for example a low side of the borehole wall, does not induce traction between the tool and the borehole. The tool may be configured so that at least one of the offset and skew angle of the downhole tool provide the above effect. The second portion may provide a rubbing contact with the borehole or tubular wall or may be offset from the borehole or tubular wall.

The collar may be reconfigurable to a larger diameter third configuration. The third configuration may be of the same diameter as the first diameter configuration or another diameter.

The downhole tool may further comprise the tubular body. The tubular body may be of any suitable form or construction. The tubular body may comprise a shaft, a mandrel or the like. The tubular body may comprise a thick wall tubular. The tubular body may comprise a section of drill pipe, drill collar or the like. The tubular body may comprise a section of bore-lining tubular. For example, the tubular body may comprise a section of casing or liner. In particular embodiments, the tubular body may comprise enhanced performance drill pipe (EPDP) or the like.

The tubular body may be configured for coupling to a tubular string, for example but not exclusively a drill string, a running string, a bore-lining tubular string, a completion string, or the like. In particular embodiments, the tubular body may be configured for coupling to the string at an intermediate position in the string. Alternatively, the tubular body may be configured for coupling to the string at an end of the string, such as a distal end of the string.

The tubular body may comprise a connector for coupling the tubular body to the tubular string. The connector may be of any suitable form. The connector may, for example, comprise at least one of a mechanical connector, fastener, adhesive bond, or the like. In some embodiments, the connector may comprise a threaded connector at one or both ends of the tubular body. In particular embodiments, the connector may comprise a threaded pin connector at a first end of the tubular body and a threaded box connector at a second end of the tubular body. In use, when the tool is run into the borehole the tubular body may be coupled to the string so that the first end having the threaded pin connector is provided at the distalmost or downhole end of the tubular body and so that the second end having the thread box connector is provided at the uphole end of the tubular body.

The tubular body may be hollow. For example, the tubular body may comprise a longitudinal bore extending at least partially therethrough. In use, the longitudinal bore may facilitate the flow of fluid through the tool.

The tubular body may define a bearing journal. For example, an outer section of the tubular body may be machined or otherwise formed to define a bearing journal onto which the traction member is rotatable mountable. Beneficially, where the tubular body defines the bearing journal, this provides structurally reliable attachment means for the traction member whilst maintaining the structural integrity of the tubular body. In other embodiments, the tubular body and bearing may comprise separate components and the tubular body may be configured to receive the bearing.

As outlined above, the tubular body may define a recess for receiving the collar or traction member. In some embodiments, the recess may form the bearing journal. In some embodiments, the recess may be configured to receive the bearing. The provision of a recess in the tubular body facilitates coupling between the collar or traction member and the tubular body and may permit forces to be transmitted from the traction member to the tubular body and the string.

The tubular body may be configured to receive the collar or traction member about the outer circumferential surface of the tubular body.

According to a third aspect of the present invention, there is provided an assembly comprising:

a downhole tool according to the first or second aspect; and a tubular body.

The assembly may comprise a single downhole tool. Alternatively, the assembly may comprise a plurality of the downhole tools.

Accordingly, embodiments of the present invention may provide a resizable, plastically deformable or crimpable elastomeric bearing collar or stabilizer sleeve which can be installed over upset sections of rotary drilling and wellbore completion tubulars such as but not limited to subs, drill collars, drill pipe, wellbore casing, production liners and other drilling and production related tubulars that are run down-hole. In order to enable the reduction of rotational torque generated when directionally drilling and completing extended reach development (ERD) wells.

It should be understood that the features defined above in accordance with any aspect of the present invention or below in relation to any specific embodiment of the invention may be utilised, either alone or in combination, with any other defined feature, in any other aspect of the invention.

BRIEF DESCRIPTION OF THE DRAWINGS

These and other aspects of the present invention will now be described by way of example with reference to the drawings, of which.

DETAILED DESCRIPTION OF THE DRAWINGS

Figure 1A:
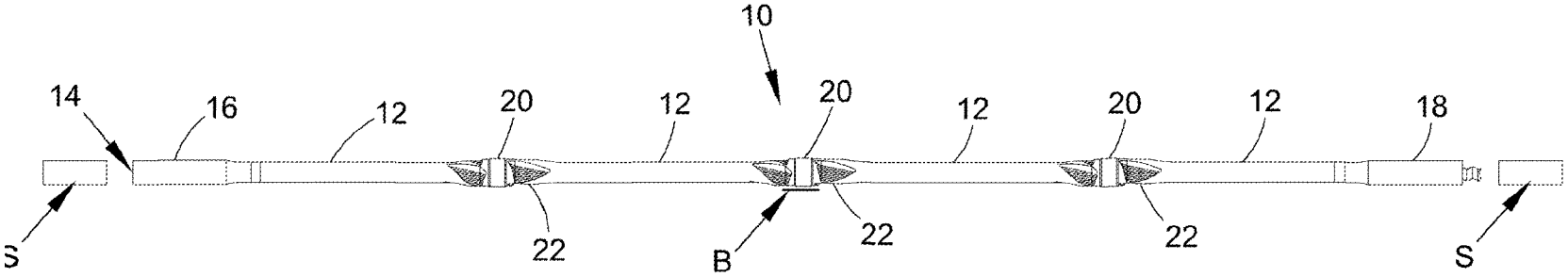
FIG. 1A shows a conventional enhanced performance or heavyweight drill pipe section.
Figure 1B:
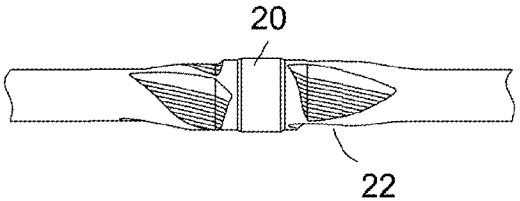
FIG. 1B shows an enlarged view of an upset portion of the pipe section shown in FIG. 1A.

Referring first to FIGS. 1A and 1B, there is shown a downhole tubular 10 in the form of a joint of conventional enhanced performance drill pipe (EPDP). As shown in FIG. 1A, the downhole tubular 10 has a main tubular body 12 having a throughbore 14, an upset threaded box connector 16 at a first end and an upset threaded pin connector 18 at a second end. In use, the threaded box and pin connectors 16, 18 are used to couple the tubular 10 to adjacent sections of a string (shown schematically at S), such as a drill string, completion string, running string or the like. A number of upset hard faced sections 20 are formed on the main body 12 of the tubular 10 along its length. As shown most clearly in FIG. 1B, the lead-ins from the main tubular body 12 to each of the hard faced upset sections 20 are milled to include low side debris agitation flutes 22. In use, the upset sections 20 provide a degree of stability to centralise and support the tubular 10 off the low side of the borehole wall (shown schematically by B). In addition, the flutes 22 resist the potential for buckling caused by the compressive loads applied to the tubular 10 when connected joints are used in a rotating drill string used to drill long horizontal sections of the borehole B.

In use, the hard faced upset sections 20 make contact with the borehole wall B and generate frictional losses which cumulatively add to the torque required to rotate the drill string S in operation. This torque is normally taken as being the vertical weight component of the tubular 10 multiplied by the coefficient of friction between the contact points 24 of the tubular 10 and the borehole wall B. The coefficient of friction is normally taken to be between 0.25 and 0.3.

Figure 2A:
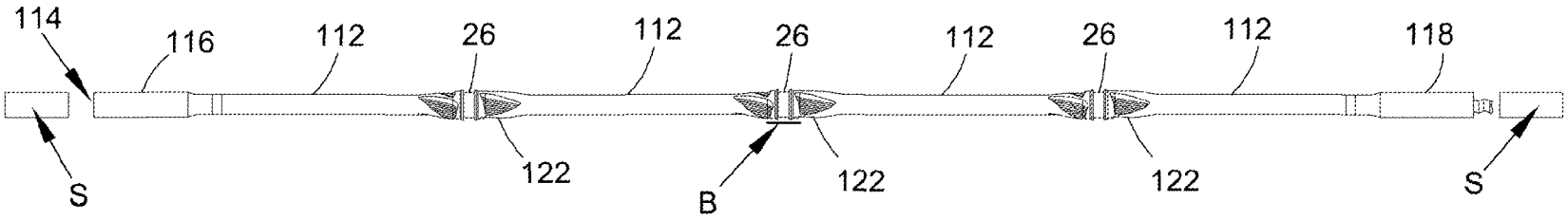
FIG. 2A shows a modified enhanced performance or heavyweight drill pipe section according to the present invention.
Figure 2B:
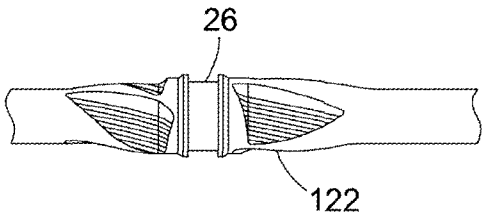
FIG. 2B shows an enlarged view of an upset portion of the pipe section shown in FIG. 2A.

Referring now to FIGS. 2A and 2B, there is shown a downhole tubular 110 for use in an embodiment of the present invention. In the illustrated embodiment, the downhole tubular 110 also comprises a joint of enhanced performance drill pipe (EPDP) and like components between the tubular 10 and the tubular 110 are represented by like components incremented by 100. As with the tubular 10, the downhole tubular 110 has a main tubular body 112 having a throughbore 114 and low side debris agitation flutes 122, an upset threaded box connector 116 at a first end, an upset threaded pin connector 118 at a second end. In use, the threaded box and pin connectors 116, 118 are used to couple the tubular 110 to adjacent sections of the string S. The downhole tubular shown in FIGS. 2A and 2B differs from the tubular 10 in that the upset hard faced sections 20 have been removed and replaced by an undercut bearing journal section 26 which, in use, receives a collar 28 as will be described further below, and which creates a torque reducing, free rotating collar or stabiliser sleeve.

Figure 3A:
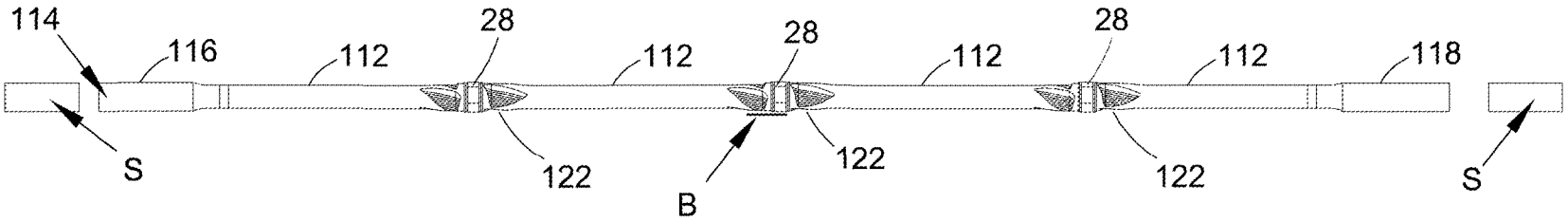
FIG. 3A shows the enhanced performance or heavy weight drill pipe section shown in FIGS. 2A and 2B with a number of reformed or crimped non-rotating collar or stabiliser sleeves located on each bearing journal.
Figure 3B:
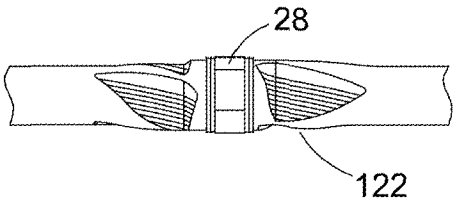
FIG. 3B shows an enlarged view of the upset portion of the pipe section shown in FIG. 3A.

As shown in FIGS. 3A and 3B, the tubular 110 has a number of collars 28 (three are shown in the illustrated embodiment), each mounted on a journal section 26. In the illustrated embodiment, the collars 28 have been crimped or swaged in place on their respective journal sections 26 and, in use, the collars 28 support the rotating drill string S along its length and help to reduce the frictional losses between rotating drill string S and the borehole wall B by acting as efficient bearings between the rotating drill pipe 110 running on the journals 26.

Figure 4A:
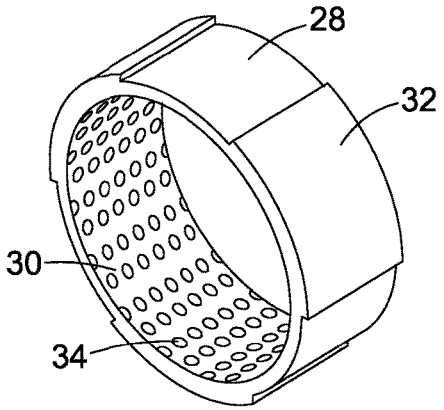
FIG. 4A shows a deformable or crimpable collar or stabiliser sleeve according to an embodiment of the present invention, the collar having integral elastomeric bearing pads prior to being reformed or crimped into place on the bearing journal.
Figure 4B:
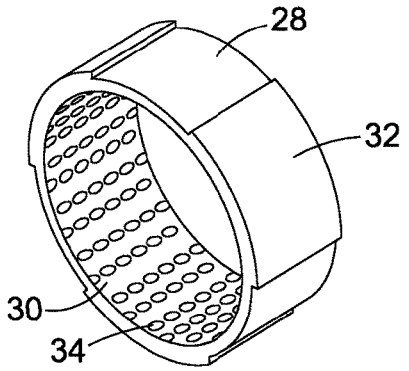
FIG. 4B shows the collar shown in FIG. 4A after being reformed or crimped to fit on to the bearing journal.

An exemplary collar 28 is shown in FIGS. 4A and 4B, FIG. 4A showing the collar 28 in a first diameter configuration before being crimped or swaged down in size and FIG. 4B showing the collar 28 in a second, smaller, diameter configuration after being crimped or swaged down in size.

In use, the collar 28 is configured for location over the tubular body 110 in its larger first configuration as shown in FIG. 4A, translated along the tubular body 110 until positioned adjacent to the journal section 26, and then reconfigured to define its smaller second diameter configuration shown in FIG. 4B, the collar 28 being secured to, and/or retained on the tubular body 110 in the second diameter configuration.

The collar 28 is manufactured as a composite component comprising a metallic ring or core 30 encapsulated within an elastomeric outer layer 32 which, in use, forms a fluid lubricated elastomeric bearing having a coefficient of friction of about 0.1 or lower. In the illustrated embodiment, the core is manufactured from grade 316 stainless steel while the outer layer 32 is constructed from hnbr rubber. The use of grade 316 stainless steel gives the core 30 sufficient ductility to permit the deformation or reconfiguration of the collar 28 from its larger first configuration shown in FIG. 4A to the smaller second configuration shown in FIG. 4B. The use of hnbr rubber provides an outer layer 32 which is capable of following the deformation of the core 30. However, it will be recognised that other suitable materials may be used where appropriate. As shown in FIGS. 4A and 4B, the core 30 is perforated having a number of circular perforations 34. In use, when crimped or crushed down in size the perforated core 30 is plastically deformed in a controlled collapse of the perforations 34. Since the core 30 is encapsulated within the outer layer 32, the act of plastic deformation of the core 30 and controlled collapse of the perforations 34 causes the elastomeric material of the outer layer 32 bonded within the perforations 34 to be extruded to form raised sections or buttons of elastomeric material to be formed in the reduced bore. These raised sections or buttons of elastomeric material create multiple bearing points on the journal section 26 with clearance space around them for fluid cooling and cleaning, thereby creating a fluid lubricated bearing surface between the internal bore of the collar 30 and the journal section 26.

Figure 5A:
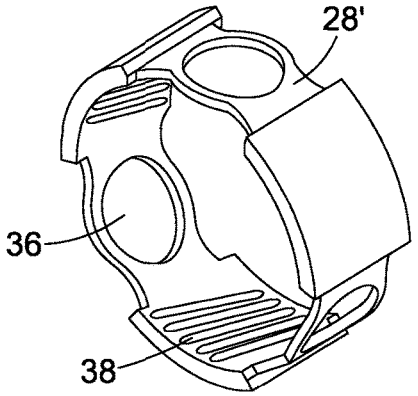
FIG. 5A shows a deformable or crimpable collar or stabiliser according to an alternative embodiment.
Figure 5B:
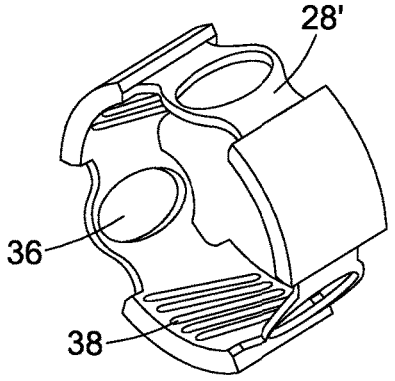
FIG. 5B shows the deformable or crimpable collar or stabiliser shown in FIG. 5B, after reforming or crimping.

Referring now to FIGS. 5A and 5B, there is shown an alternative collar 28', FIG. 5A showing the collar 28' in a first diameter configuration before being crimped or swaged down in size and FIG. 5B showing the collar 28' in a second, smaller, diameter configuration after being crimped or swaged down in size. In this embodiment, the collar 28' comprises a resizable, or deformable bearing collar or stabiliser sleeve manufactured from a ductile plastically deformable metal. As shown in FIGS. 5A and 5B, the collar 28' comprises a deformable portion 36 which can be controllably crimped, swaged or deformed down from the first configuration shown in FIG. 5A to the second configuration shown in FIG. 5B, the reduced internal diameter of the collar 28' forming a running fit in the journal section 26 in use. Elastomeric or polymer bearing strips 38 are installed in preformed grooves or pockets 40 prior to crimping in position on the journal section 26, thus forming a fluid lubricated bearing surface between the internal bore of the collar 28' or stabiliser sleeve and the journal section 26. The elastomer or polymer bearing strips 38 may be set in helical or angled fashion as shown in FIGS. 5A and 5B to induce the flow of cooling and lubricating fluid throughout the bearing in operation.

Figure 6:
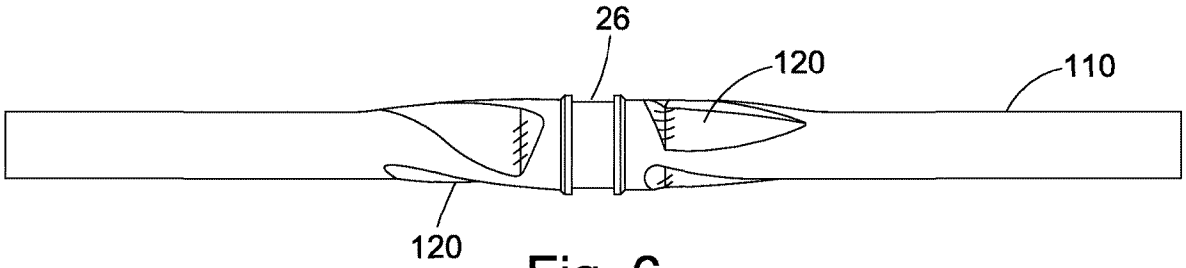
FIG. 6 shows an enlarged section of the drill pipe shown in FIGS. 2 and 3 with the low side debris agitation flutes and the upset section more clearly defined.
Figure 7:
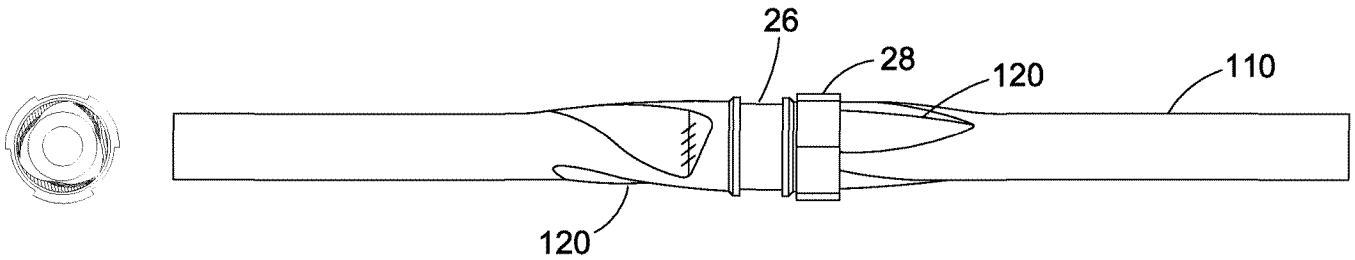
FIG. 7 shows an enlarged section of the drill pipe shown in FIG. 6 with the unreformed collar or stabiliser sleeve being passed over the upset section after having been passed over one of the upset box or pin tool joints.
Figure 8:
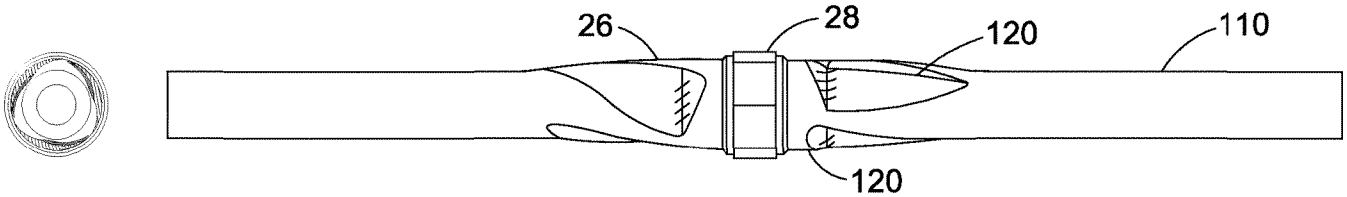
FIG. 8 shows the enlarged section of the drill pipe shown in FIG. 6 with the reformed or crimped collar or stabiliser in place on the bearing journal.

Referring now to FIGS. 6, 7 and 8, there is shown a sequence of installing a resizable, or deformable bearing collar or stabiliser sleeve onto the tubular body 110 of a modified enhanced performance or heavyweight drill pipe with a recessed bearing journal 26 located in an upset section 120. The collar may comprise the collar 28 or the collar 28'. FIG. 6 shows the recessed bearing journal section 26 prior to installing the resizable, or deformable bearing collar or stabiliser sleeve. FIG. 7 shows the resizable, or deformable bearing collar or stabiliser sleeve 30 in its untrimmed state being passed over the upset 120. FIG. 8 shows the resizable, or deformable bearing collar or stabiliser sleeve 28 crimped onto the bearing journal section 30. As shown in FIG. 8, in the installed state the plastically deformable ring or sections are below the level of the upset 120. Beneficially, this arrangement eliminates or at least mitigates the risk of wear through should the elastomeric or polymer bearing fail and cause the ring to lock on to the bearing journal, and thus maintains the structural integrity of the collar 28.

Figure 9:
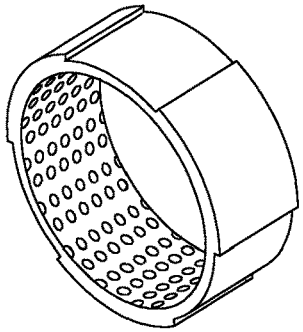
FIG. 9 shows an unreformed collar or stabiliser sleeve.
Figure 10:
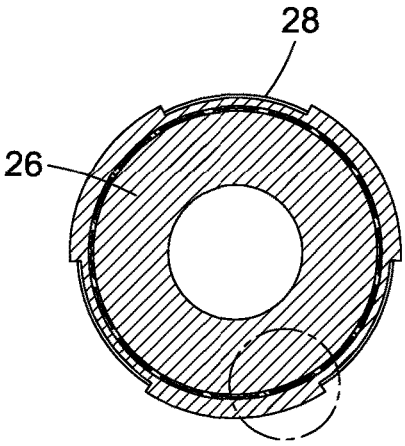
FIG. 10 shows cross section of reformed or crimped collar or stabiliser sleeve located on the bearing journal.
Figure 11:
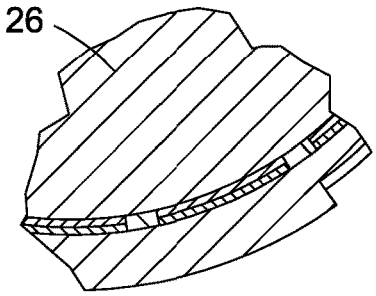
FIG. 11 shows an enlarged section B of FIG. 10.
Figure 12:
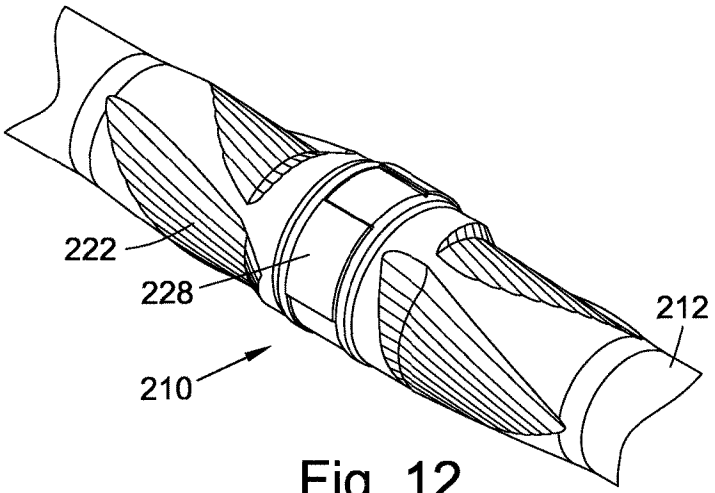
FIG. 12 shows a perspective view of a downhole tool according to an alternative embodiment of the present invention.
Figure 13:
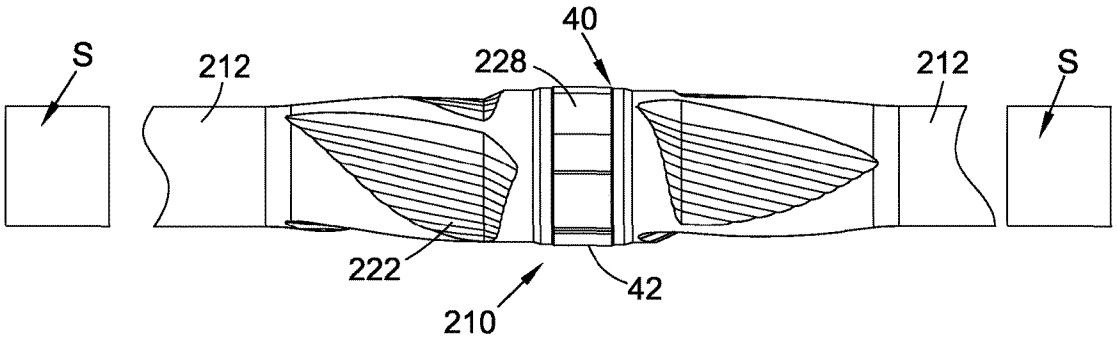
FIG. 13 shows an elevation view of the downhole tool shown in FIG. 12.

FIGS. 9, 10 and 11 show additional views of the embodiments of the present invention, FIG. 9 showing an unreformed collar or stabiliser sleeve; FIG. 10 showing a cross sectional view of reformed or crimped collar or stabiliser sleeve located on the bearing journal; and FIG. 11 showing an enlarged section B of the cross section view shown in FIG. 10.

Embodiments of the present invention provide a number of benefits, including inter alia, providing torque reducing collars or stabiliser sleeves with integral fluid lubricated elastomeric and or polymer bearings which can be attached or installed on to bearing journals that are smaller in diameter than the upset drill pipe tool joint connections while eliminating the requirement to have split connections in the collar or stabiliser sleeves or the use of clamping mechanisms to attach split collars or stabiliser sleeves. A particular embodiment of the invention relates to the provision of a method of attaching a torque reducing collars or stabiliser sleeves in the form of resizable or deformable rings incorporating fluid lubricated elastomeric and or polymer bearing materials which can be installed over upset sections of drilling or completion related tubulars and then resized or reformed by plastic deformation or circumferential sections or an integral central core of the ring to a smaller size to create a free running fit on to one or more bearing journals located on the tubular body between the upsets. However, it should be understood that the embodiments described herein are merely exemplary and that various modifications may be made thereto without departing from the scope of the invention.

Figure 14:
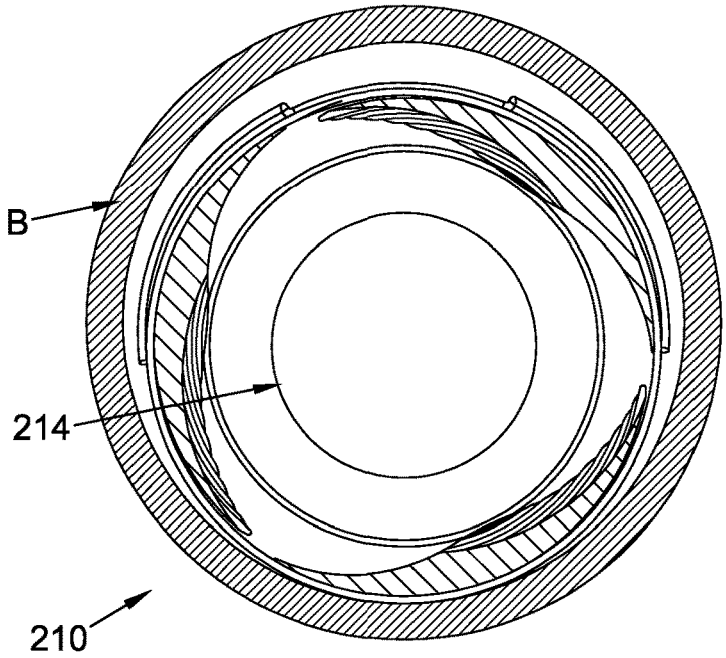
FIG. 14 shows an end view of the downhole tool shown in FIGS. 12 and 13 in a first configuration.
Figure 15:
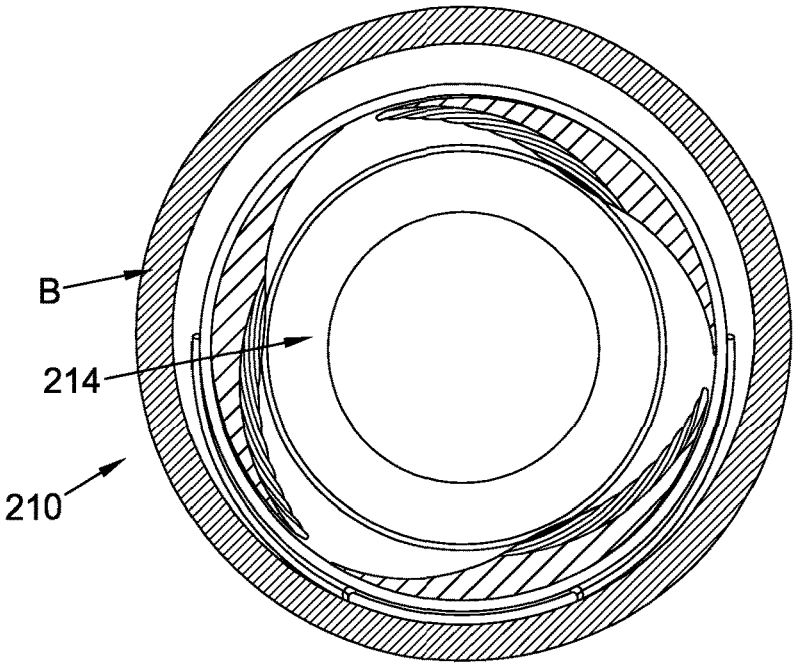
FIG. 15 shows an end view of the downhole tool shown in FIGS. 12 to 14, in a second configuration.

Referring to FIGS. 12 to 15, there are shown perspective, elevation, and end views respectively of a downhole tool according to an alternative embodiment of the present invention. FIG. 14 shows the tool in a first position with a borehole B. FIG. 15 shows the tool in a second position within the borehole B. In the illustrated embodiment, the downhole tool comprises a tubular 210, the tubular 210 also comprising a joint of enhanced performance drill pipe (EPDP) and like components between the tubulars 10, 110 and the tubular 210 are represented by like components incremented by 200. As with the tubular 10, the downhole tubular 210 has a main tubular body 212 having a throughbore 214 and low side debris agitation flutes 222. Although not shown, the tubular 210 will also comprise an upset threaded box connector at a first end, an upset threaded pin connector at a second end which, in use, are used to couple the tubular 210 to adjacent sections of the string S. In this embodiment, the collar 228 is provided with an offset and skew angle which on contacting the wall of the tubular or borehole B provides traction. In the illustrated embodiment, the offset is 3 mm and the skew angle is about 1 degree. In use, the tool is configured so that a first portion 40 of the collar 228 engages a high side of the borehole or tubular wall B and a section portion 42 of the collar 228 engages a low side of the borehole or tubular wall. The first portion 40 of the collar 228 comprises the offset and skew and so induce traction when engaged with the borehole or tubular wall B, while the second portion 42 does not induce traction but rather provides a rubbing contact when engaged with the borehole, or may be offset from the borehole wall.

For example, the second diameter may alternatively comprise a larger diameter configuration than the first diameter configuration.

While in the illustrated embodiments, the collar comprises a composite component, the collar may comprise a unitary component.

What is claimed is:

1. A downhole tool comprising;

a tubular body;

a collar for location on said tubular body, the collar reconfigurable from a first diameter configuration in which the collar comprises an initial internal diameter which permits the collar to pass over and translate along the tubular body, to a second, smaller, diameter configuration in which the collar comprises a second, smaller, internal diameter, wherein the collar is configured to be plastically deformed to reconfigure the collar from the first diameter configuration to the second, smaller, diameter configuration, wherein the collar is rotatably mounted on the tubular body in the second configuration, and wherein an outer surface of the collar is configured for engagement with a borehole or bore-lining tubular as the downhole tool is run downhole, the collar configured to support and offset the tubular body from said borehole or bore-lining tubular to reduce or mitigate friction as the downhole tool is run downhole.

2. The downhole tool of claim 1, wherein the collar comprises or forms part of a bearing, optionally a fluid lubricated bearing.

3. The downhole tool of claim 1, wherein the collar comprises a deformable portion, wherein the deformable portion permits reconfiguration of the collar from the first diameter configuration to the second diameter configuration.

4. The downhole tool of claim 3, wherein the deformable portion comprises a ductile material, optionally a ductile metal.

5. The downhole tool of claim 1, wherein the collar comprises a core.

6. The downhole tool of claim 5, wherein the core comprises a cylindrical tubular body, or ring.

7. The downhole tool of claim 5, wherein the core comprises or forms part of a deformable portion of the collar.

8. The downhole tool of claim 1, wherein the collar comprises at least one outer layer.

9. The downhole tool of claim 1, wherein the collar comprises at least one perforation.

10. The downhole tool of claim 9, wherein the collar is configured so that reconfiguring the collar from the first diameter configuration to the second diameter configuration collapses one or more of the perforations.

11. The downhole tool of claim 9, wherein the collar comprises a core, and where at least one perforation is provided in the core.

12. The downhole tool of claim 8, wherein the collar is configured so that reconfiguring the collar from the first diameter configuration to the second diameter configuration extrudes or deforms the outer layer.

13. The downhole tool of claim 12, wherein the collar is configured so that reconfiguring the collar from the first diameter configuration to the second diameter configuration extrudes or deforms part of the outer layer through one or more perforation.

14. A method for reducing torque and/or drag in a downhole environment using the downhole tool of claim 1.

15. The downhole tool of claim 1, wherein the collar is configured in the second configuration to engage, to be secured to, and/or retained on a smaller diameter section of the tubular body.

16. The downhole tool of claim 8, wherein at least one of:

the outer layer is provided on at least one of an outer surface and an inner surface of the core;

the outer layer encapsulates the core.

17. The downhole tool of claim 8, wherein at least one of:

the outer layer is constructed from a polymeric elastomeric material;

the core is constructed from a metallic material or metallic alloy.

18. The downhole tool of claim 15, wherein the smaller diameter section of the tubular body comprises at least one of a bearing journal, a recess, and a preformed location.

19. The downhole tool of claim 1, wherein the collar comprises one or a plurality of radially extending ribs, blades or upset diameter portions.

20. A method comprising:

providing a downhole tool according to claim 1;

locating the collar on said tubular body;

reconfiguring the collar from said first diameter configuration to said second, smaller, diameter configuration, wherein reconfiguring the collar from the first diameter configuration to the second diameter configuration comprises plastically deforming the collar, and wherein the collar is rotatable relative to the tubular body in the second configuration.

21. The method of claim 20, wherein reconfiguring the collar from the first diameter configuration to the second diameter configuration comprises at least one of:

swaging the collar or part of the collar;

crimping the collar or part of the collar; and crushing the collar or part of the collar.

22. A downhole tool comprising a collar for location on a tubular body, the collar reconfigurable from a first diameter configuration to a second, smaller, diameter configuration via plastic deformation, wherein the collar comprises a core comprising at least one perforation and at least one outer layer, and wherein the collar is configured so that reconfiguring the collar from the first diameter configuration to the second, smaller, diameter configuration extrudes or deforms part of the outer layer through the one or more perforation.

23. A method comprising:

providing a downhole tool comprising a collar, wherein the collar comprises a core comprising at least one perforation and at least one outer layer;

locating the collar on a tubular body; and reconfiguring the collar from a first diameter configuration to a second, smaller, diameter configuration, via plastic deformation wherein reconfiguring the collar from the first diameter configuration to the second, smaller, diameter configuration extrudes or deforms part of the outer layer through the one or more perforation.

24. A downhole tool comprising a collar for location on a tubular body, the collar reconfigurable from a first diameter configuration to a second, smaller, diameter configuration via plastic deformation, wherein the collar is constructed from an elastomeric material, and wherein the collar is configured for translation along the tubular body in the first diameter configuration and to engage the tubular body in the second diameter configuration, and wherein the collar is rotatably mounted on the tubular body downhole in the second configuration.

25. A method comprising:

providing a downhole tool comprising a collar, wherein the collar is constructed from an elastomeric material;

locating the collar on a tubular body in a first configuration;

translating the collar along the tubular body in the first configuration;

reconfiguring the collar from the first diameter configuration to a second, smaller, diameter configuration and via plastic deformation, wherein the collar engages the tubular body in the second configuration, and wherein the collar is rotatable relative to the tubular body in the second configuration.

* * * * *